United States Patent [19]

Brown et al.

[11] Patent Number: 4,718,138

[45] Date of Patent: Jan. 12, 1988

[54] FOOTWEAR SCRAPER

[75] Inventors: Steven R. Brown, 156 W. Elm, Louisville, Colo. 80027; Gene A. Fisher, Highlands Ranch, Colo.

[73] Assignee: Steven R. Brown, Louisville, Colo.

[21] Appl. No.: 874,701

[22] Filed: Jun. 16, 1986

[51] Int. Cl.[4] ..... A63C 11/18; A63C 11/22; A47L 23/00; A47L 23/22

[52] U.S. Cl. ..... 15/237; 15/236 R; 280/813; 280/819

[58] Field of Search ..... 280/813, 812, 816–820, 280/809; 15/237–241, 236 R, 236 A, 236 C

[56] References Cited

U.S. PATENT DOCUMENTS

| | | | |
|---|---|---|---|
| D. 266,574 | 10/1982 | Krive | D21/2 |
| 419,801 | 1/1890 | Sparrow | 15/237 |
| 2,094,145 | 9/1937 | Dunn | 15/237 |
| 2,507,807 | 5/1950 | Newbern | 15/237 X |
| 2,557,229 | 6/1951 | Lyster | 15/237 X |
| 2,579,006 | 12/1951 | Mims | 15/237 |
| 3,350,111 | 10/1967 | Sahlein et al. | 280/813 |
| 3,929,345 | 12/1975 | Nasby et al. | 280/813 |
| 4,000,909 | 1/1977 | Coale | 280/813 |
| 4,129,312 | 12/1978 | Loffelholz | 280/813 |
| 4,145,062 | 3/1979 | Stiemert | 280/813 |
| 4,145,063 | 3/1979 | Knapp et al. | 280/813 |
| 4,221,393 | 9/1980 | Donahue | 280/813 |
| 4,358,138 | 11/1982 | Laughlin et al. | 280/813 X |

FOREIGN PATENT DOCUMENTS

| | | | |
|---|---|---|---|
| 2104014 | 8/1972 | Fed. Rep. of Germany | 280/813 |
| 2355748 | 5/1975 | Fed. Rep. of Germany | 280/813 |

*Primary Examiner*—John Petrakes
*Attorney, Agent, or Firm*—Robert E. Harris

[57] ABSTRACT

A device for removal of matter from shoes and boots is disclosed. The device includes a scraping portion, a mounting portion, and a rotatable member for mounting the scraping portion on the mounting portion so that the scraping portion can be rotated, relative to the mounting portion, between stored and operative positions, with the rotatable member being biased to urge the scraping portion toward the operative position upon actuation of a release mechanism connected with the rotatable member. The device is mounted upon, or integrated with, a handle structure, such as, for example, a ski pole, so that, when so mounted or integrated, the scraping portion is substantially aligned with the handle structure in the stored position and is rotated to a position extending in a direction away from the handle structure in the operative position.

17 Claims, 9 Drawing Figures

6
10
14
12
18
16
6

12
14
10
16

16
10
12
14

35
18
20
28
28
28
16
14
22
26
24
26
24
34
26
26
24
18
35
12
35
32
30
10

FOOTWEAR SCRAPER

FIELD OF THE INVENTION

This invention relates to devices for removal of matter from shoes and boots, and, more particularly, relates to ski pole mountable devices for removal of unwanted matter from ski shoes and ski boots.

BACKGROUND OF THE INVENTION

Devices for removal of unwanted matter from shoes and boots are well known, and it is also well known that such devices not only have been heretofore utilized in many diverse configurations but have also heretofore been mounted on, or utilized in conjunction with, other structures, including handles or poles.

In particular, devices for removal of matter from ski shoes and ski boots are well known, including devices which are used in association with ski poles. Examples of such usage are described in U.S. Pat. Nos. 3,929,345, issued Dec. 30, 1975 to Robert D. Nasby et al, 4,145,062, issued Mar. 20, 1979 to Cyrus R. Stiemert, 4,221,393, issued Sept. 9, 1980 to Arnold Donahue, and 4,000,909, issued Jan. 4, 1977 to Sidney C. Coale. As described, the devices are integrated with a ski pole, and the portion utilized for removal of matter is maintained substantially aligned with the pole at all times.

Other arrangements, again by way of example, are shown by U.S. Pat. No. 4,129,312, issued Dec. 12, 1978 to Eberhard Loffelholz, and U.S. Pat. No. Des. 266,574, issued Oct. 19, 1982 to Irwin M. Krive. As described, the devices are arranged on a ski pole, and, while the portion used for removal of matter extends in a direction away from the pole, this position is maintained at all times.

Still further examples are shown in U.S. Pat. Nos. 3,350,111, issued Oct. 31, 1967 to William J. Sahlein et al, and 4,145,063, issued Mar. 20, 1979 to Gregory T. Knapp et al. As described, the portion of the device used for removal of matter is stored in a position substantially aligned with a pole and is extendable at an angle away from the pole for use, but all such movement must be manually carried out.

Thus, while devices for removal of matter from shoes and boots for use in association with handles or poles have heretofore been suggested and/or utilized, further improvements could nevertheless still be utilized.

SUMMARY OF THE INVENTION

This invention provides a variably positionable device for removal of matter from shoes and boots, for example, ski shoes and ski boots, used in association with a handle or pole, for example, a ski pole. The overall device utilizes a scraper portion, a mounting portion, and an actuatable biased rotation member to move the scraper portion from a stored position to an operative position with respect to the mounting portion which can be mounted, for example, on a handle or pole. The rotation member is configured in a manner so as to allow storage of the scraper portion in a position substantially aligned with the handle or pole, to automatically realign the scraper portion, by actuating the biased rotation member, to a position extending in a direction away from the handle or pole for use of the scraper portion, and to allow return of the scraper portion thereafter to the stored position.

It is therefore an object of this invention to provide an improved device for removal of matter from shoes and boots.

It is another object of this invention to provide an improved device for use in association with a handle or pole for removal of matter from shoes and boots.

It is still another object of this invention to provide an improved device for removal of matter from ski shoes and ski boots.

It is yet another object of this invention to provide an improved device for removal of matter from shoes and boots which may be maintained in either a stored position or an operative position.

It is still another object of this invention to provide an improved device for removal of matter from shoes and boots which is capable of actuatable biased rotation from a stored position to an operative position.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The following drawings, in combination with the Specification, illustrate a complete embodiment of the invention according to the mode so far devised for the practical application of the principles thereof, and in which.

DESCRIPTION OF THE INVENTION

Figures 1, 2, 3, 4:
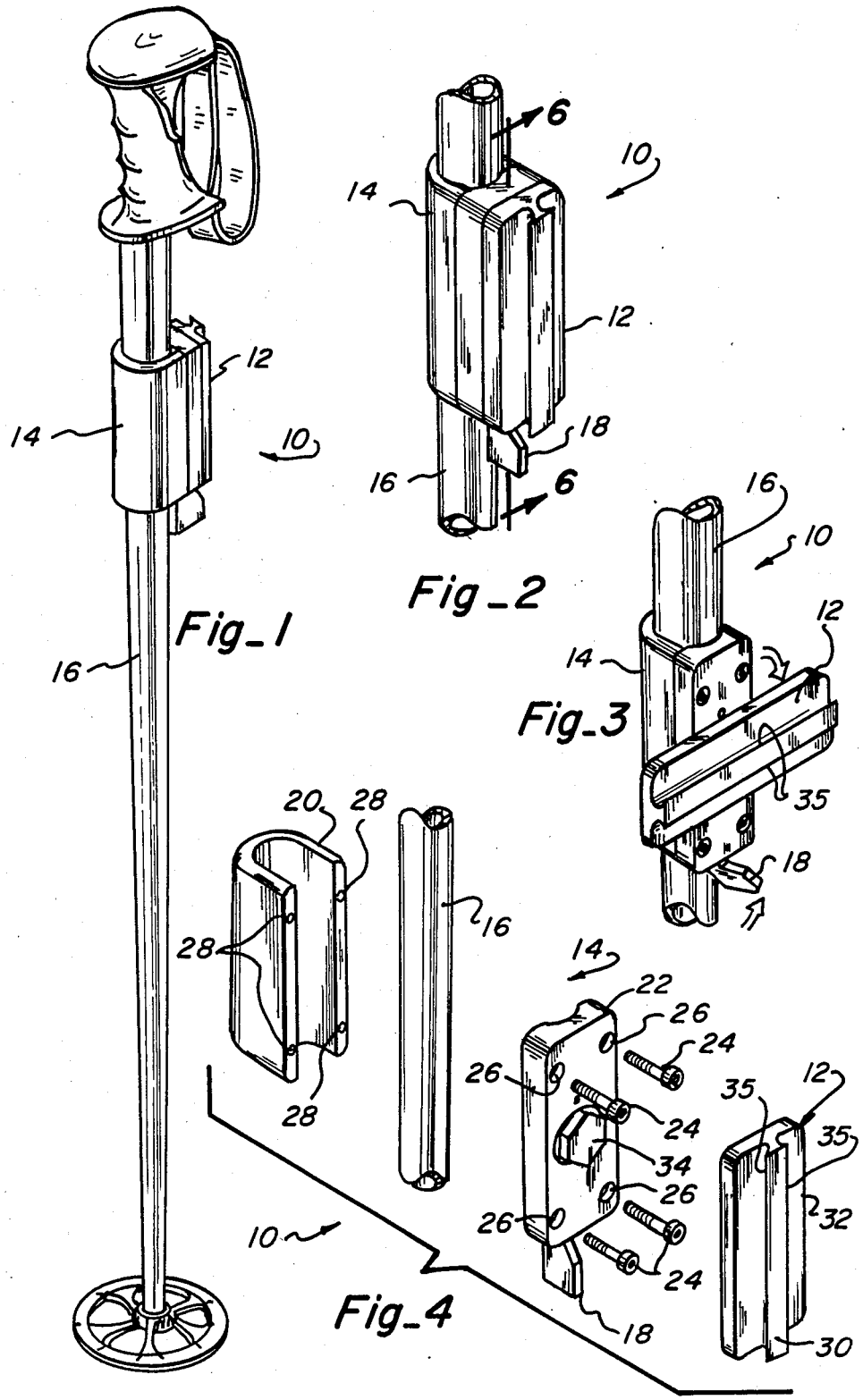
FIG. 1 is a perspective view of a footwear scraper in accord with this invention mounted on a ski pole.
FIG. 2 is a perspective view of the footwear scraper as shown in FIG. 1 illustrating the scraper in its stored position.
FIG. 3 is a perspective view of the footwear scraper shown in FIG. 1 with the scraper in its operative position.
FIG. 4 is an exploded perspective view illustrating the relationship of the mounting section to the scraping section of the footwear scraper.

Referring now to the drawings, a ski boot scraper 10 is shown in FIG. 1 and 2 with the scraper portion 12 in the stored position parallel to the mounting portion 14 mounted on ski pole 16.

As shown in FIG. 3, scraper portion 12 is caused to turn to its operative position perpendicular to pole 16, by manipulation of lever 18, where it is ready for use. Turning to FIG. 4, mounting portion 14 includes mounting plate 20 and mechanism housing 22, plate 20 and housing 22 being maintained around pole 16 by hex screws 24 through openings 26 in housing 22 and threaded openings 28 in plate 20, screws 24 being tightened until ski boot scraper 10 is held firmly in place on pole 16. Scraper portion 12 includes scraping blade 30 on base 32, base 32 being mounted to hexagonal shaft 34 in housing 22 as more fully set forth below. Scraping blade 30 may be, for example, blunted at the top portion thereof, dual, laterally extending blades 35 being thereby formed for safer storage and use.

Figure 5:
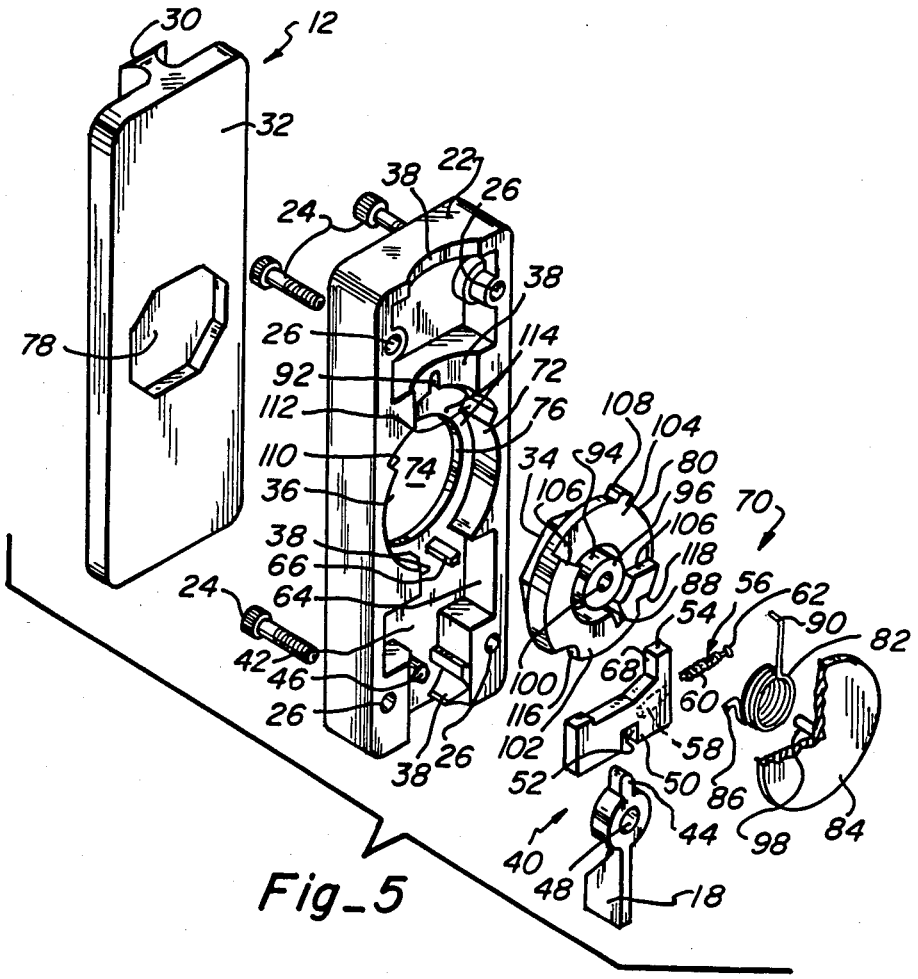
FIG. 5 is a partial exploded rear perspective view illustrating the mechanism housing and scraper of the instant invention.

In FIG. 5, mechanism housing 22 is shown from the opposite perspective of that shown in FIG. 4 and without mounting plate 20 attached thereto. Mechanism housing 22 includes concavity 36, a portion of which forms ski pole receiving walls 38. Trigger mechanism 40 resides in trigger cavity 42 of mechanism housing 22. Trigger mechanism 40 consists of lever 18 having actuator 44 connected thereto and mounted on shaft 46 through opening 48. Slide release 50 is slidable by actuator 44 upon clockwise manipulation of lever 18, actuator 44 being maintained in slot 52, and includes release arm 54. Trigger biasing assembly 56 is maintained in mounting hole 58 (best shown in FIG. 7a) in slide release 50 and includes spring 60 and spring stiffening pin 62. Biasing assembly 56 is maintained against wall 64 of trigger cavity 42 and biases release arm 54 toward stop 66 where it is tightly maintained at shoulder 68 by spring 60.

Figure 6:
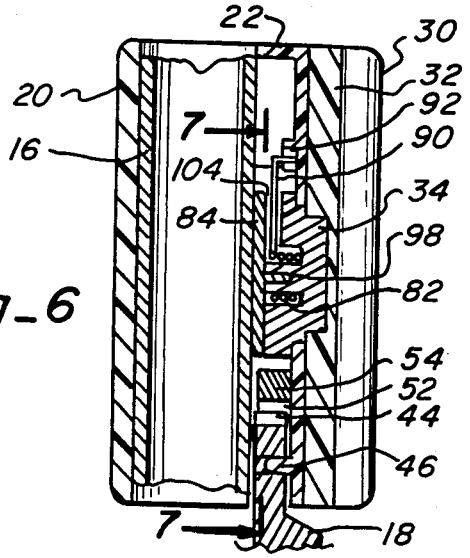
FIG. 6 is a cross sectional view along section line 6—6 of FIG. 2; and FIGS. *7a* through *7c* are cross sectional views of the footwear scraper shown in FIG. 6 illustrating movement of the scraper from its stored position to its operative position.

Pivot assembly 70 is maintained in mechanism housing 22 at pivot assembly cavity 72, which includes shaft opening 74 through rear wall 76 of mechanism housing 22. Shaft 34 is rotatably mounted through opening 74 and is attached, as by gluing, fusing or the like, to scraper base 32 at hexagonal shaft mounting cavity 78. Pivot assembly 70 includes pivot disk 80 integrally connected to shaft 34, torsion spring 82 and spring cover 84. Torsion spring 82 has a small end 86 which resides in mounting slot 88 within pivot disk 80 and a large hooked end 90 which resides in mounting hole 92 within pivot assembly cavity 72 at one pole receiving wall 38, spring 82 fitting in spring housing slot 94 and around spring shaft 96. Spring 82 is retained in slot 94 by spring cover 84 having centrally located connecting pin 98 maintained in spring shaft opening 100 and mounted on pivot disk shoulder 102. When cover 84 is in place, slot 104 is formed (as shown in FIG. 6) which conforms to the range of rotation of pivot disk 80, hooked end 90 of spring 82 being maintained in a static position in slot 104 with one of slot walls 106 being alternately adjacent hooked end 90 when scraper portion 12 is in either operative or stored positions. Stop 108 travels a similar range between range limiting walls 110 and 112 in cavity 72.

When pivot disk 80 is in place in cavity 72 it therefore is allowed to pivot on lip 114, its range of rotation limited to approximately 90° by contact of stop 108 with walls 110 and 112. Pivot disk 80 has described in the sides thereof detents 116 and 118, placed approximately 90° apart, for engaging of release arm 54 of slide release 50 and corresponding to the operative and stored positions of scraper portion 12.

Figure 7A:
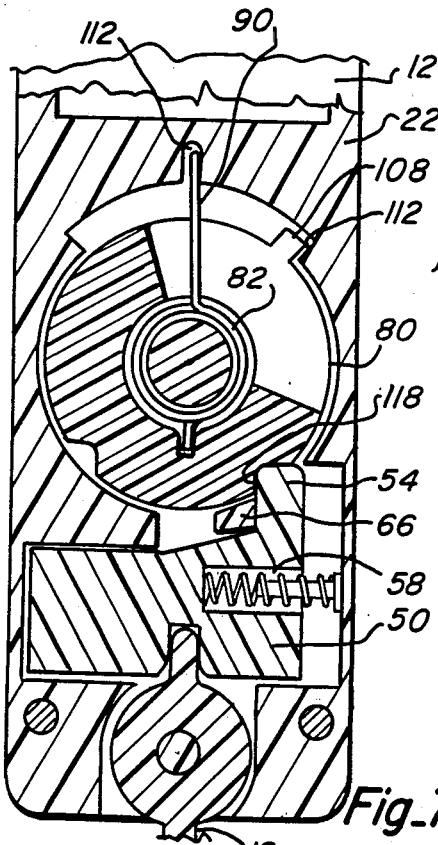
Figure 7B:
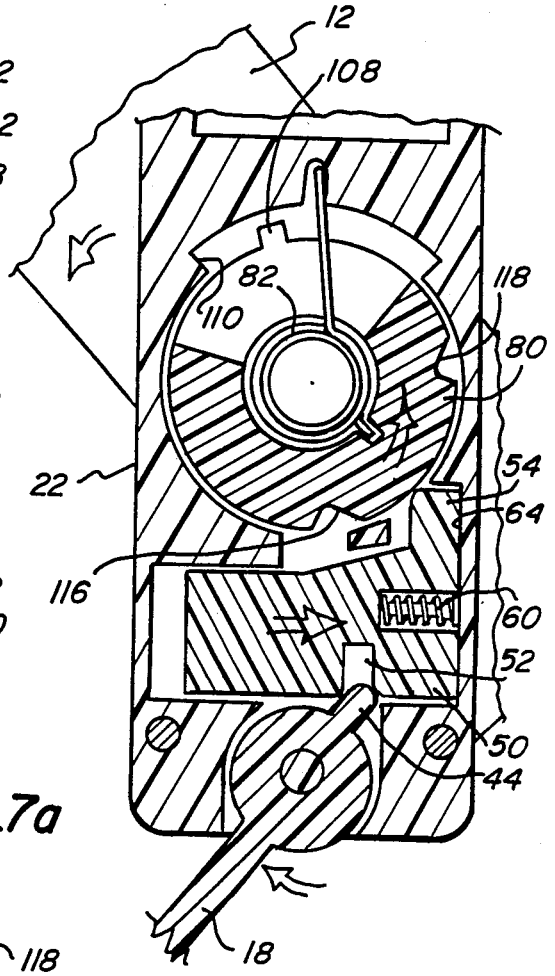
Figure 7C:
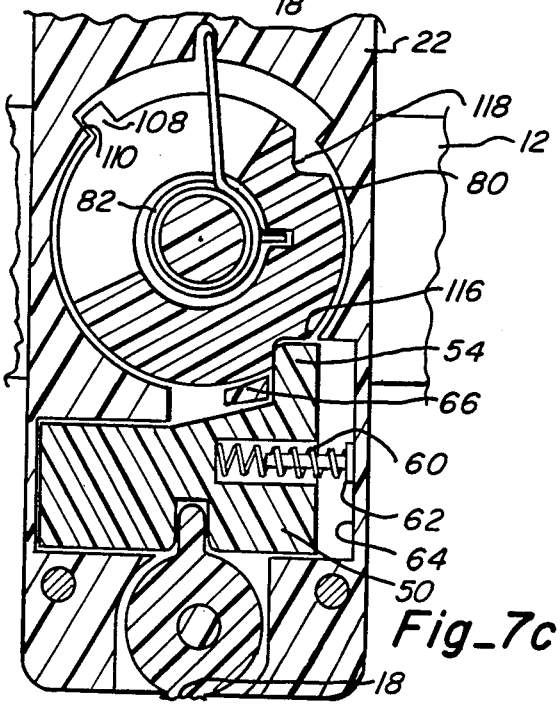

Turning now to FIGS. 7a through 7c, operation of the mechanism is illustrated. In FIG. 7a scraper portion 12 is shown in its stored position parallel to housing 22 being cooperatively maintained thereat by release arm 54 within detent 118 and against stop 66 and by stop 108 against wall 112. In this position spring 82 is more tightly coiled than would be the case if scraper portion 12 were in its operative position.

As shown in FIG. 7b, when lever 18 is manipulated release arm 54 is freed from detent 118 when actuator 44 in slot 52 moves slide release 50 toward wall 64, spring 82 thereby being allowed to uncoil and rotate pivot disk 80 and scraper portion 12 in a counterclockwise direction and urging pivot stop 108 toward wall 110.

In FIG. 7c scraper portion 12 has completed its rotation and is now in its operative position, being cooperatively maintained thereat by release arm 54 within detent 116 and against stop 66 and by stop 108 against wall 110. Release arm 54 automatically engages detent 116 when spring 60 biases slide release 50 toward pivot disk 80 upon release of lever 18. For return to the stored position, lever 18 is again manipulated thereby releasing release arm 54 from detent 116 thus allowing a user to turn scraper portion 12 in a clockwise direction until detent 118 is presented to release arm 54 for re-engagement as shown in FIG. 7a.

Spring 82 may be formed of a 0.031" wire and the spring itself may have, for example, a diameter of 0.490". The torsion spring may be closely wound for a total of 5 turns, for example. Mounting portion 14, hexagonal shaft 34, trigger mechanism 40, slide release 50 and pivot disk 80 can all be formed, for example, of plastic, aluminum, or any other durable material. Scraper portion 12 is, for example, a polycarbonate material, and may be of varying sizes. Trigger spring 60 is a compression wound spring. Spring stiffening pin 62 is shorter than spring 60 and may be made of any durable material.

As can be appreciated from the foregoing, this invention provides an improved footwear scraper which is constructed to allow a storable scraper, stored so as not to cause bulges near the body, such as when devices are stored in pockets, which may be made ready for use automatically, and may be mounted on a pole, the pole thereby providing a handle.

What is claimed is:

1. A device for enabling removal of matter from a ground engagable unit, said device comprising:
   - hand usable means;
   - scraper means having a scraping portion and a mounting portion spaced from said scraping portion;
   - mounting means positioned at said hand usable means; and
   - connecting means, having a rotatable portion, connecting said mounting portion of said scraper means with said mounting means, rotation of said rotatable portion of said connecting means causing said scraping portion of said scraper means to be adjacent to said hand usable means when in a stored position, and causing said scraping portion of said scraper means to extend from said hand usable means when in an operative position, said connecting means including actuation means for causing rotation of said rotatable portion so that said scraping portion is automatically caused to assume a predetermined one of said positions upon actuation of said actuating means.

2. The device of claim 1 wherein said ground engagable unit is one of a ski shoe and a ski boot.

3. The device of claim 1 wherein said hand usable means is a ski pole.

4. The device of claim 1 wherein said actuation means includes releasable securing means for releasably securing said scraping portion of said scraper means in said position adjacent to said hand usable means when in said stored position and for releasably securing said scraping portion of said scraper means in said position extending away from said hand usable means when in said operative position.

5. The device of claim 4 wherein said actuation means includes biasing means for urging said scraping portion of said scraper means from said stored position to said operative position.

6. The device of claim 5 wherein said device includes manually actuatable means for causing movement of said scraping portion of said scraper means in a direction in opposition to the direction urged by said biasing means whereby said scraping portion of said scraper means, upon release from said operative position by said releasable securing means, is movable between said operative position and said stored position.

7. The device of claim 1 wherein said scraper means is made of a polycarbonate material.

8. The device of claim 1 wherein said scraping portion of said scraper means includes two scraping surfaces, said scraping surfaces being substantially parallel and facing in opposite directions.

9. A variably positionable shoe and boot scraper attachable to a member having an elongated portion, said scraper comprising:

a scraping portion;

mounting means mountable on said member; and rotation means, connected between said mounting means and said scraping portion, for causing said scraping portion to be movable between at least a stored position and an operative position;

biasing means for urging said rotation means from said stored position to said operative position; and releasable securing means for releasably securing said rotation means in said stored position so that said scraping portion is substantially aligned with said elongated portion of said member and, upon release from said stored position and movement to said operative position, for releasably securing said rotation means in said operative position so that said scraping portion extends in a direction away from said elongated portion.

10. The scraper of claim 9 wherein said member is a ski pole.

11. The scraper of claim 9 which includes manually actuatable means for rotation in a direction in opposition to the direction urged by said biasing means whereby said scraping portion, upon release from said operative position by said releasable securing means of said rotation means, is movable between said operative position and said stored position.

12. The scraper of claim 9 wherein said scraping portion and said mounting means are made of a polycarbonate material.

13. A variably positionable ski shoe and ski boot scraper attachable to a ski pole, said scraper comprising:

a scraping portion;

mounting means mountable on said ski pole;

connecting means connected between said mounting means and said scraping portion, for causing said scraping portion to be movable between a stored position substantially aligned with said ski pole and an operative position extending in a direction away from said ski pole, said connecting means including a rotatable disk attachable to said scraping portion, said disk movable between said stored position and said operative position and having first and second detents therein at positions corresponding to said stored position and said operative position respectively;

biasing means connected between said mounting means and said disk for urging said disk in a direction from said stored position to said operative position; and disk position control means including release means mounted in said mounting means, said release means having a hand manipulable portion and actuating means, said actuating means being adjacent to said disk, and retainer means between said actuating means and said disk, whereby said actuating means when at a first position maintains said retainer means within said first detent and whereby, upon movement of said hand manipulable portion of said release means, said actuating means is moved to a second position, said retainer means thereby being freed from said first detent allowing said disk to be rotated by said biasing means from said stored position to said operative position whereat said actuating means urges said retainer means into said second detent;

whereby said scraping portion may be releasably secured in said stored position and by manipulation of said hand manipulable portion of said release means is automatically repositioned in said operative position.

14. The scraper of claim 13 which includes manually actuatable means for rotation in a direction in opposition to the direction urged by said biasing means whereby said scraping portion, upon release from said operative position by said release means, is movable between said operative position and said stored position.

15. The scraper of claim 13 wherein said release means includes a biasing portion for urging said actuating means from said second position to said first position.

16. The scraper of claim 13 wherein said scraper is in substantial part made of a polycarbonate material.

17. The scraper of claim 13 wherein said rotatable disk and said mounting means have cooperable movement limiting means for further resisting movement of said scraping portion when in said stored and said operative positions.

* * * * *